United States Patent [19]

Short

[11] Patent Number: 4,680,934

[45] Date of Patent: Jul. 21, 1987

[54] BOILER FOR A TORPEDO AND SYSTEM INCLUDING THE SAME

[75] Inventor: Keith E. Short, Rockford, Ill.

[73] Assignee: Sundstrand Corporation, Rockford, Ill.

[21] Appl. No.: 892,178

[22] Filed: Aug. 4, 1986

[51] Int. Cl.[4] ..... F01K 13/02

[52] U.S. Cl. ..... 60/652; 114/20.2; 122/21

[58] Field of Search ..... 60/652, 667, 668; 114/20.2; 122/21; 126/263

[56] References Cited

U.S. PATENT DOCUMENTS 1,003,095 9/1911 D'Equevilley-Montjustin .
1,224,105 4/1917 Davison .
3,379,178 4/1968 Boyars et al. .
3,469,555 9/1969 Greiner .
3,486,332 12/1969 Robertson et al. .
3,771,313 11/1973 Kaiho .
3,964,416 6/1976 Kiraly et al. .

*Primary Examiner*—Stephen F. Husar
*Attorney, Agent, or Firm*—Wood, Dalton, Phillips, Mason & Rowe

[57] ABSTRACT

Weight, noise and response difficulties in boilers utilized in torpedoes are eliminated in a construction including a housing having an interior wall, defining a chamber with at least one oxidant inlet. A plurality of working fluid conduits each have an inlet and an outlet exterior of the housing and heat exchange section within the chamber. Each heat exchange section is a plural convolution coil and the individual convolutions of each conduit are interleaved with the individual convolutions of the other conduits. Valves control the flow of working fluid through at least some of the conduits independently of the others.

12 Claims, 3 Drawing Figures

BOILER FOR A TORPEDO AND SYSTEM INCLUDING THE SAME

FIELD OF THE INVENTION

This invention relates to a propulsion system for a torpedo, and more particularly, to a novel boiler for use in a propulsion system and a system utilizing such a boiler.

BACKGROUND OF THE INVENTION

Torpedo propulsion systems frequently utilize a vaporized working fluid such as water to drive a turbine which in turn drives a suitable propulsor. In a typical case, the water is vaporized in a boiler which in turn is heated by an intense, exothermic chemical reaction. Not infrequently, metallic lithium is oxidized with sulfur hexafluoride for the purpose. One proposal of such a boiler is found in U.S. Pat. No. 3,964,416 issued June 22, 1976 to Kiraly et al.

In the Kiraly device, the boiler is made up of a containment can in which a helical coil having an inlet and an outlet is disposed. Feed water is directed to the inlet of the coil and steam exits the outlet for application to the turbine as a lithium-sulfur hexafluoride reaction occurs.

Other similar boilers lacking the containment can have also been employed. In such a case, the adjacent convolutions of the coil are welded together in sealed relation so that the coil itself serves as the containment for the chemical reaction.

In either case, the boiler construction is not as desirable as might be. For one, the reacting fuel will have contact generally only with the radially inner surface of the conduit forming the coil in either instance since adjacent coils are welded together or are in substantial abutment with the containment can as in Kiraly. While heat will flow to the radially outer sides of the conduit by conduction through the conduit itself so that heat transfer does occur to the working fluid at the radially outer side of the conduit, heat transfer is not as efficient as if the entire periphery of the coil were within the reacting bath of molten lithium.

Furthermore, during operation, vibrations may occur which may in turn cause adjacent convolutions of the coil to contact each other and/or, where a containment can is used, the containment can itself. This will generate noise which may aid in detection of the torpedo and therefore is to be highly avoided.

Moreover, modern torpedoes are frequently sonar guided and run at one speed until commanded to enter a search mode. The speed of the torpedo is then changed to a speed appropriate for the search. Once the target is determined, the speed may be changed again to an intercept speed.

As the guidance system of the torpedo makes such decisions, it is highly desirable that the propulsion system of the first torpedo respond as rapidly as possible.

It is also highly desirable that the torpedo propulsion system be capable of rapid start up. It is likewise important that the weight of the torpedo be minimized, particularly where the torpedo is to be released from an aircraft or the like.

The present invention is intended to overcome the foregoing difficulties and achieve the stated desirabilities.

SUMMARY OF THE INVENTION

It is the principal object of the invention to provide a new and improved boiler for a torpedo propulsion system. It is an object of the invention to provide such a boiler and an associated propulsion system, as well.

According to one facet of the invention, there is provided a boiler for use in a torpedo which comprises a housing containing a fuel which, when oxidized, will generate heat. The housing has an interior wall defining a chamber. At least one oxidant inlet is located in the housing and extends to the chamber. Within the chamber is a plurality of working fluid conduits each having an inlet and an outlet exterior of the housing and a heat exchange section within the chamber. Each heat exchange section comprises a plural convolution coil, the individual convolutions of each conduit being interleaved with the individual convolutions of the other conduits. Means are provided for controlling the flow of working fluid through at least some of the conduits independently of the others.

A preferred embodiment of a system including the boiler includes a turbine wheel and a plurality of turbine nozzle sets associated therewith. Each nozzle set includes at least one nozzle and where more than one nozzle is included in each set, the nozzles of each set are peripherally adjacent to each other without the presence of intervening nozzles of another set. Each set is connected to the outlet of a respective conduit. The controlling means are thereby operative to independently control the sets of nozzles from which working fluid will emanate during operation of the system.

Such a construction provides a number of advantages over prior art systems such as those identified above. The use of plural conduits which may be connected in parallel for independent operation allows the use of smaller conduits without sacrificing efficiency to increased pressure drop. The use of smaller conduits minimizes the working fluid inventory within the boiler to thereby improve start up and control response. The use of smaller conduits also provides a weight savings in that wall thickness of the conduits can be substantially reduced.

Control response is also improved because of the ability to individually control a plurality of conduits as power needs require.

An exemplary embodiment of the invention further contemplates that the coils be helixes and that the convolutions be in non contacting relation with each other to allow oxidation of fuel in the chamber in contact with substantially the entire periphery of the respective heat exchange sections of the conduits. This feature improves heat transfer to maximize efficiency of operation. This feature also assures that the convolutions are spaced from each other sufficiently to prevent contact between adjacent convolutions as a result of vibration or the like during operation of the boiler. Consequently, noise generation is reduced.

Preferably, the diameter of the coils is substantially less than the diameter of the chamber, which is cylindrical, such that the convolutions are substantially spaced from the wall of the chamber and out of contact therewith, again for the purpose of minimizing noise generation. A preferred embodiment contemplates the use of coil forms or supports on the interior wall of the housing which mount the coils in the chamber in the desired relation.

In a highly preferred embodiment, the controlling means comprise control valves at the inlets of the conduits which are independently operable.

Other objects and advantages will become apparent from the following specification taken in connection with the accompanying drawings.

DESCRIPTION OF THE PREFERRED EMBODIMENT

Figure 1:
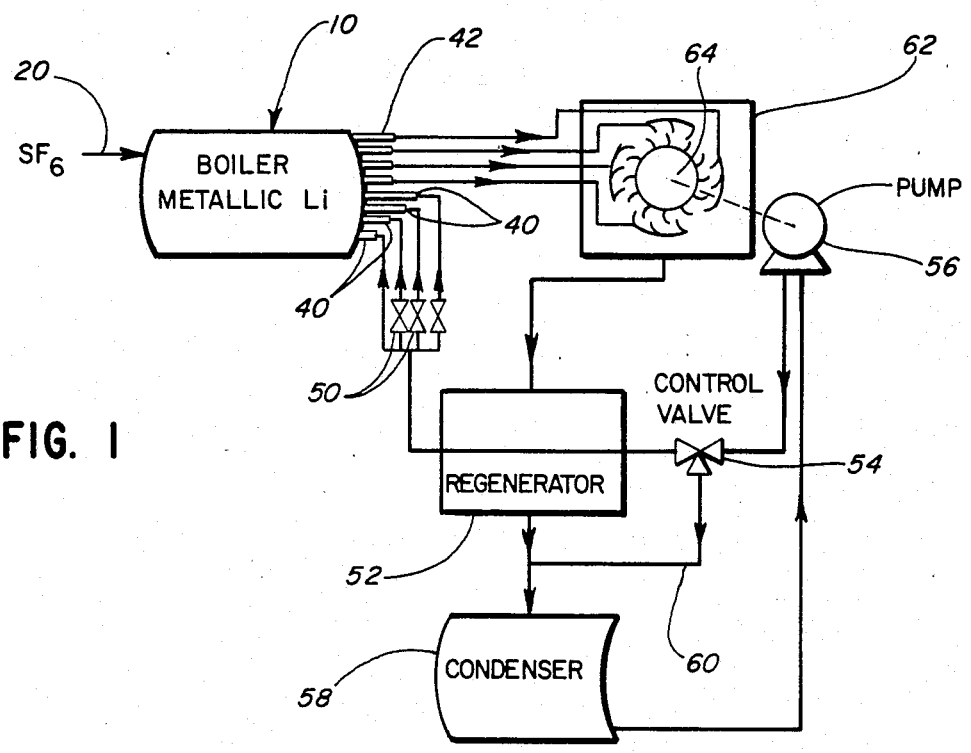
FIG. 1 is a schematic of a torpedo propulsion system made according to the invention.

An exemplary embodiment of a boiler made according to the invention and a system employing the same is illustrated in the drawings and will be described herein as a propulsion source for a torpedo. However, it will be appreciated that the same may be utilized for other purposes as, for example, a power generating system capable of rapid start up.

In any event, the system includes a boiler generally designated 10, containing metallic lithium. The boiler 10 is in the form of a generally cylindrical housing 12 having an interior cylindrical wall 14 and opposed end walls 16 and 18.

Figure 2:
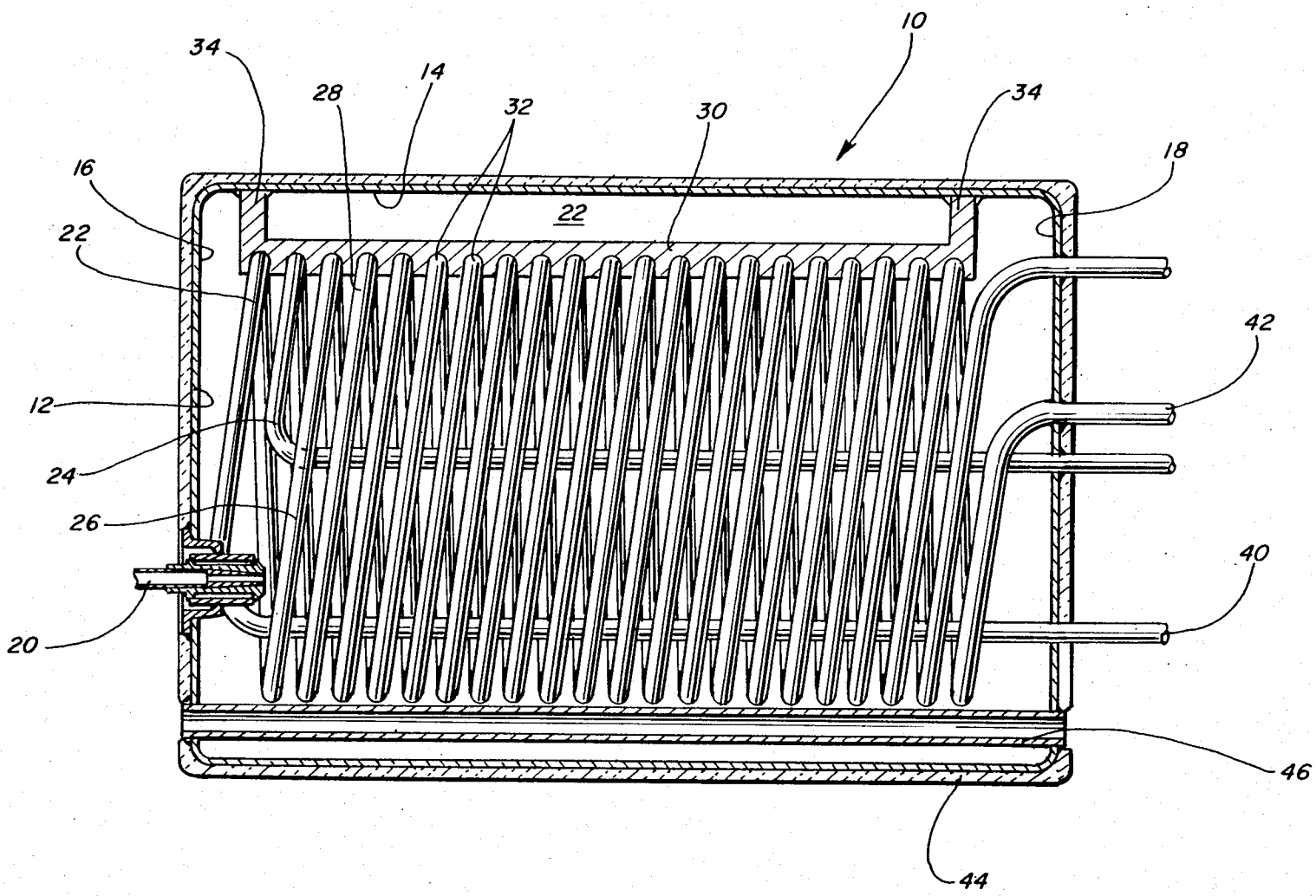
FIG. 2 is a sectional view of a boiler employed in the system.

As best seen in FIG. 2, located within the end wall 16 is an oxidant injector 20 which may be utilized to inject sulfur hexafluoride for the purpose of participating in an oxidation reaction with the metallic lithium to generate heat.

Figure 3:
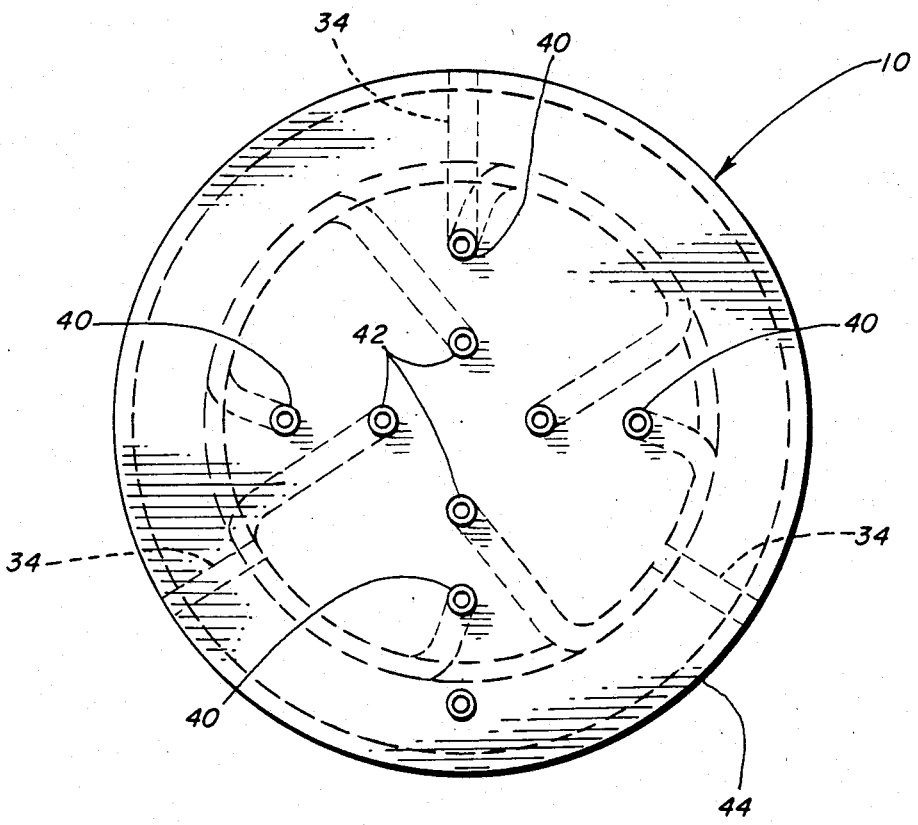
FIG. 3 is an end view of the boiler.

The boiler includes internal provision for the flow of working fluid. As best seen in FIG. 2, four helical conduits are located within a chamber 21 defined by the walls 14, 16 and 18. A first such conduit is designated 22; a second designated 24; a third designated 26 and a fourth designated 28. It will be observed that adjacent convolutions of the conduits 22, 24, 26 and 28 are interleaved with each other in alternating fashion and are spaced from one another in non contacting relationship. A plurality of coil forms are utilized to support the various convolutions in this manner. One such coil form is illustrated in FIG. 2 and includes an axially extending arm 30 having radially inwardly opening notches 32 receiving the convolutions of the conduits 22, 24, 26 and 28. The ends of the arm 30 include integral legs 34 which are secured to the wall 14 of the chamber 21. As seen in FIG. 3, plurality of the coil forms may be distributed at regular intervals about the internal circumference of the chamber 21.

It will be appreciated from FIG. 2 that adjacent convolutions of the conduits 22, 24, 26 and 28 are maintained in non contacting relation by the coil forms, for the purposes mentioned previously, namely, to permit oxidation of the fuel about the entire periphery of each conduit and to prevent noise generating contact between adjacent convolutions in the event of vibration during operation of the boiler.

It will also be seen that the diameter of the coiled portion of the conduits 22, 24, 26 and 28 is substantially less than the inner diameter of the boiler 10. This assures that the convolutions cannot vibrate against the wall 14 to generate noise and assures that the radially outer sides of the conduits 22, 24, 26 and 28 will be in contact with the fuel being oxidized to maximize heat transfer. Each of the conduits 22, 24, 26 and 28 has a respective inlet 40 in the form of a portion of the conduit passing through the end wall 18. Similarly, each is provided with an outlet 42 which is similarly formed by a portion of the corresponding conduit passing through the end wall 18.

In a preferred embodiment, the boiler is encapsulated in a layer 44 of insulating material. The insulating material minimizes inefficient loss of heat from the interior of the boiler to the surrounding area and further serves to provide a good measure of noise isolation as well.

Finally, one or more tubular through passages 46 may extend between the end walls 16 and 18. Hydraulic lines, etc. required to pass through the torpedo from one side of the boiler 10 to the other may be passed through the passages 46 if desired.

Returning to FIG. 1, it will be seen that three of the four inlets 40 are provided with valves 50. The valves 50 are independently controllable and may be off-on valves. Feed water is provided to the boiler via a regenerator 52 which is connected to the inlet side of the valves 50 as well as to the remaining inlet 40. As a consequence of this construction, feed water will always be flowing through one of the conduits 22, 24, 26 and 28 while flow through the remaining conduits will be dependent upon whether the corresponding valve 50 is open or closed.

Feed water to the regenerator is provided via a control valve 54 from a pump 56. The pump 56 receives feed water from a condenser 58. A bypass line 60 may interconnect the control valve 54 and the condenser 58 to divert feed water from the boiler when the pump 56 is delivering more feed water than is demanded.

Spent steam is condensed in the condenser 58 after having been utilized to preheat the feed water within the regenerator 52. The spent steam is taken from a sump or the like in a housing 62 containing a turbine wheel shown schematically at 64. Preferably, the turbine wheel 64 may be utilized to drive the pump 56.

Disposed in groups or sets circumferentially about the turbine wheel 64 is a plurality of turbine nozzles. One such group includes nozzles designated 66; another group includes nozzles designated 68; a third group includes nozzles designated 70; and the fourth group includes nozzles designated 72. Each group or set of nozzles is connected to an associated one of the outlets 42. It will also be noted that the nozzles in each set are circumferentially adjacent to one another without the presence of intervening nozzles from another set and that the sets are circumferentially distributed about the turbine wheel 64.

The valve 54 and valves 50 can be conventionally controlled by the guidance system of the torpedo. In this respect, the valves 50 provide what may be termed a "coarse" control over turbine output while a "fine" control is provided by operation of the valve 54.

By arranging the various nozzles 66, 68, 70 and 72 in sets as described before and connecting them to parallel flow paths through the boiler, so-called entrance and exit losses occurring within the turbine 62 are minimized. Thus, overall efficiency is maximized. Furthermore, and as alluded to previously, the use of parallel, individually controlled flow paths through the boiler allow smaller tubing to be utilized to thereby minimize the internal inventory of water within the boiler. Another feature that minimizes working fluid inventory within the boiler is the use of the valves 50. When one or more of the valves 50 is closed, any liquid phase working fluid in the associated conduit 22, 24, 26 and 28 will be rapidly vaporized and passed to the turbine 62. When a change in speed is commanded, the absence of working fluid means a lesser mass whose temperature need be changed in that point in time to provide suitable response.

Furthermore, the use of smaller conduits minimizes the mass required to form the conduit; and it can be demonstrated that the mass reduction is proportional to the ratio of the diameter of the large tubing employed in the prior art and the smaller tubing employed according to the invention.

It can also be shown that by connecting the flow paths in parallel, the use of smaller tubing is allowed without increasing pressure drop which would hurt efficiency. In particular, in order to maintain the same heat transfer surface area with smaller tubing, a greater length of tubing would normally have to be employed. The longer length of tubing to achieve the same heat transfer area would proportionately increase the pressure drop. However, parallel flow according to the inventive arrangement allows the use of the requisite length of tubing without any consequential increase in pressure drop.

What is claimed is:

1. A boiler for use in a torpedo or the like and comprising:

a housing containing a fuel which, when oxidized, will generate heat, said housing having an interior wall defining a chamber;

at least one oxidant inlet in said housing and extending to said chamber;

a plurality of working fluid conduits each having an inlet and an outlet exterior of said housing and a heat exchange section within said chamber, each said heat exchange section comprising a plural convolution coil, the individual convolutions of each conduit being interleaved with the individual convolutions of the other conduits; and means for controlling the flow of working fluid through at least some of said conduits independently of the others.

2. The boiler of claim 1 wherein said coils are helixes and said convolutions are in non contacting relation with each other to allow oxidation of fuel in the chamber in contact with substantially the entire periphery of the respective heat exchange sections of the conduits.

3. The boiler of claim 1 wherein said convolutions are spaced from each other sufficiently to prevent contact between adjacent convolutions as a result of vibration or the like during operation of the boiler.

4. The boiler of claim 1 wherein said coils are helical and said chamber is cylindrical, the diameter of said coils being substantially less than the diameter of said chamber such that said convolutions are substantially spaced from said wall and out of contact therewith; and coil forms on said wall and mounting said coils in said chamber.

5. The boiler of claim 4 wherein adjacent ones of said convolutions are spaced from each other sufficiently to prevent contact between the same as a result of vibration during operation of said boiler and sufficiently to allow oxidation of said fuel in said chamber in contact with the entire periphery of each of said conduits.

6. The boiler of claim 1 in combination with a turbine including a turbine wheel and a plurality of turbine nozzle sets, one for each of said conduits and connected thereto to receive working fluid therefrom, each set having at least one nozzle and, when having more than one nozzle, the nozzles of each set being peripherally adjacent to each other without the presence of intervening nozzles of another set, said controlling means thereby being operative to independently control the sets of nozzles from which working fluid will emanate.

7. The combination of claim 6 wherein said controlling means comprise valves at the inlets of said at least some conduits.

8. A boiler for use in a torpedo or the like and comprising;

a housing containing a fuel which, when oxidized, will generate heat, said housing having an interior wall defining a cylindrical chamber;

at least one oxidant inlet in said housing and extending to said chamber;

a plurality of working fluid conduits each having an inlet and an outlet exterior of said housing and a heat exchange section within said chamber, each said heat exchange section comprising a helical plural convolution coil, the individual convolutions of each conduit being interleaved with the individual convolutions of the other conduits;

said convolutions being in spaced, non contacting relation with each other and with said wall to allow oxidation of fuel in the chamber in contact with substantially the entire periphery of said heat exchange section to prevent noise generating contact between adjacent convolutions as a result of vibration during operation of the boiler.

9. The boiler of claim 8 further including coil forms on said wall and supporting said convolutions in said spaced non contacting relation.

10. A propulsion system for use in a torpedo or the like and comprising;

a boiler housing containing a fuel which, when oxidized, will generate heat, said housing having an interior wall defining a chamber;

at least one oxidant inlet in said housing and extending to said chamber;

a plurality of working fluid conduits each having an inlet and an outlet exterior of said housing and a heat exchange section within said chamber, each said heat exchange section comprising a plural convolution coil, the individual convolutions of each conduit being interleaved with the individual convolutions of the other conduits;

means at said conduit inlets for controlling the flow of working fluid through at least some of said conduits independently of the others;

a turbine wheel; and a plurality of sets of turbine nozzles associated with said wheel, each set being connected to an associated one of said inlets and having a plurality of nozzles.

11. The propulsion system of claim 10 wherein the nozzles of each said set are circumferentially adjacent to each other, said sets being circumferentially disposed about said wheel.

12. The propulsion system of claim 10 wherein said controlling means comprises individually operated valves.

* * * * *